US008347889B2

(12) United States Patent
Farnum

(10) Patent No.: US 8,347,889 B2
(45) Date of Patent: Jan. 8, 2013

(54) AIRWAY POSITIONING DEVICE

(76) Inventor: Timothy Joseph Farnum, Evergreen, CO (US)

( * ) Notice: Subject to any disclaimer, the term of this patent is extended or adjusted under 35 U.S.C. 154(b) by 527 days.

(21) Appl. No.: 12/583,241

(22) Filed: Aug. 17, 2009

(65) Prior Publication Data

US 2011/0036354 A1 Feb. 17, 2011

(51) Int. Cl.
*A61G 15/00* (2006.01)

(52) U.S. Cl. ..... 128/845; 128/870; 602/17; 5/622; 5/637; 5/638

(58) Field of Classification Search ..... 128/845, 128/848, 857, 866, DIG. 23, 97.1, 870; 297/391–393; 433/140; 482/11; 27/25.1, 27/13; 5/622, 637–638; 600/238, 226–231, 600/102; 602/17
See application file for complete search history.

(56) References Cited

U.S. PATENT DOCUMENTS

| | | | | | |
|---|---|---|---|---|---|
| 354,976 | A | * | 12/1886 | Field | 248/484 |
| 1,131,802 | A | * | 3/1915 | Stenshoel | 27/13 |
| 1,441,817 | A | | 1/1923 | McCullough | |
| 1,729,525 | A | | 9/1929 | Stenshoel | |
| 1,776,167 | A | | 9/1930 | Stenshoel | |
| 2,452,816 | A | | 11/1948 | Wagner | |
| 3,188,079 | A | * | 6/1965 | Boetcker et al. | 5/622 |
| 4,064,401 | A | * | 12/1977 | Marden | 5/601 |
| 4,700,691 | A | * | 10/1987 | Tari et al. | 5/622 |
| 4,867,404 | A | * | 9/1989 | Harrington et al. | 606/46 |
| 5,524,639 | A | | 6/1996 | Lanier et al. | |
| 5,865,730 | A | * | 2/1999 | Fox et al. | 600/228 |
| 5,976,080 | A | * | 11/1999 | Farascioni | 600/213 |
| 5,984,864 | A | * | 11/1999 | Fox et al. | 600/201 |
| 6,506,149 | B2 | * | 1/2003 | Peng et al. | 600/37 |
| 6,581,889 | B2 | * | 6/2003 | Carpenter et al. | 248/160 |
| 7,182,731 | B2 | * | 2/2007 | Nguyen et al. | 600/229 |

OTHER PUBLICATIONS

Medsurplusonline—Acrobat Mechanical Stabilizer System, retrieved from the Internet Feb. 22, 2010, http://www.medsurplusonline.com/productDetails.php?prodId=4446, 2 pages.
Medtronic Octopus 4 Surgical Solutions, retrieved from the Internet Feb. 22, 2010, http://www.medtronic.com/cardsurgery/products/mics_octopus4.html, 3 pages.

* cited by examiner

*Primary Examiner* — Nicholas Lucchesi
*Assistant Examiner* — Kari Petrik
(74) *Attorney, Agent, or Firm* — Lathrop & Gage LLP

(57) ABSTRACT

A positioning device to facilitate the maintenance of a patent airway by correctly positioning a patient's head under anesthesia during an operation or procedure comprising at least one adjustable support including a plurality of segments or sections selectively positionable relative to adjacent segments or sections and selectively lockable relative to each other having a patient engaging member coupled to the proximal end portion thereof to engage a portion of the patient's head to maintain the position of the patient's head during an operation or procedure.

11 Claims, 5 Drawing Sheets

AIRWAY POSITIONING DEVICE

BACKGROUND OF THE INVENTION

1. Field of the Invention

A positioning device to facilitate the maintenance of a patent airway by correctly positioning the patient's head under anesthesia during an operation or procedure.

2. Description of the Prior Art

Monitored Anesthesia Care (MAC) anesthesia is commonly used as an anesthetic technique. Specifically, drugs introduced into the bloodstream are used in combination with a local anesthetic applied to the operative site. MAC anesthesia may be employed in combination with anesthesia such as spinals, epidurals, and peripheral nerve blocks, which also provide temporary loss of feeling and movement at the operative site. Unfortunately, an upper airway obstruction may occur when using MAC anesthesia technique due to respiratory depression and/or relaxation of airway musculature.

To reduce the risk of an upper airway obstruction, an anesthetist should position the airway to maintain airway patency. In particular, the anesthetist will manually lift the chin upwards. This correctly positions the head tilt and results in anterior displacement of the mandible with airway structures which contributes to patient air exchange. Alternatively a jaw-thrust maneuver may be employed by placing hands at both sides of the mandible and laterally and thrusting the jaw forward. Either method requires the anesthetist to support the patient's head manually throughout the surgery.

U.S. Pat. No. 1,131,802 shows a device comprising a frame having a pair of angular adjustable side extensions, a vertically adjustable head rest detachably mounted on the frame with freedom for horizontal adjustment longitudinally of the side extensions a pair of vertically adjustable jaw rests mounted on the side extensions for movement toward and away from the head rest.

U.S. Pat. No. 1,441,817 relates to an apparatus comprising a base plate and a pair of spaced jaw props adjustable on the base plate at an angle thereto. The jaw props includes the sole projections on the base plate, and the base plate being sufficiently narrow so that it may be placed beneath the neck of a corpse and be adjusted longitudinally of the neck of a corpse while the shoulders of the corpse and the head of the corpse rest upon a head board independently of the base plate.

U.S. Pat. No. 1,729,525 teaches a device comprising a vertically adjustable head rest, jaw rests, angularly and lengthwise adjustable supporting means for and carrying the jaw rests carried by the head rest, a supporting structure and head rest having contacting means for latching the head rest in adjusted position, the means including a pair of supports hinged to the head rest and a combined coupling and adjusting device for the supports, the jaw rests being vertically and angularly adjustable with respect to the means, the means further having the forward ends thereof apertured for receiving the jaw rests and carrying at their forward ends clamping devices for maintaining the jaw rests in adjusted position.

U.S. Pat. No. 1,776,167 shows a device comprising an adjustable head rest element including a pair of oppositely disposed downwardly inclined extensions and a vertical post, an adjustable supporting element including an angle shaped pivoted arm arranged below the head rest element, the supporting element including means for latching the arm, an adjustable coupling device between the post and the arm, a pair of angle shaped oppositely extending jaw rest elements, adjustable coupling devices between the jaw rest elements and the extensions and adjustable shoulder drawing down means pivotally and adjustably connected to the extensions.

U.S. Pat. No. 2,452,816 discloses a jaw supporting device comprising a base member means for securing the base member to and transversely of a table top, abutments upstanding in adjustable spaced opposition from the base member, means for selectively adjusting the abutments longitudinally of the base member. A straight cylindrical stem clampably swiveled to extend upwardly from each abutments upper end, a tubular element telescoped over each stem and slidable axially thereon, means for clamping the tubular element to and in selectively adjusted positions along the stem, a mounting block clampably swiveled to the free end of each tubular element and a jaw engaging cushion removably and replaceably clipped to and in supported relation against each block.

U.S. Pat. No. 4,700,691 relates to a restraining and supporting device for the head of a patient comprising a head immobilizing contraption connected to the operating table, arm and hand supports for the surgeon, wherein the hand supports are fixed to the head immobilizing contraption through flexible arms, also provided with elements releasing or tightening the flexible arms, which elements are fitted to one of the fingers of the surgeon's hand, or interconnected with hand and/or foot switch. The head immobilizing contraption consists of nape support provided with a three-point bearing for the head and can be set at an adjustable height. A front support clamps down the head into the nape support and is connected to the nape support through a hinged mechanism. The flexible arms are attached to the front support of the head immobilizing contraption.

U.S. Pat. No. 5,524,639 discloses an apparatus intended to maintain or improve a supine patient's airway in a hands-free environment. A frame and detachable pillow device are placed under the patient's head. Mechanisms extend laterally from the frame and provide jaw support members that may be brought under the angles of the jaw. The jaw support members may slide towards and away from the frame, but this sliding movement is regulated by a unidirectional clutch, such as a ratchet and pawl system, which restricts the jaw support members to sliding movement away from the frame only. When the jaw support members are slid away from the frame, they engage the angles of the jaw, and then thrust the jaw forward to maintain or improve the patient's airway. Once the desired anteriorly thrust position of the jaw is achieved, the unidirectional clutch holds the jaw in place until the clutch is released. The weight of the jaw then causes the jaw support members to slide back towards the frame, restoring the jaw to its normal position.

SUMMARY OF THE INVENTION

The present invention relates to a positioning device to facilitate the maintenance of a patent airway by correctly positioning a patient's head under anesthesia during an operation or procedure comprising at least one adjustable support arm including a plurality of segments or sections configured to be selectively positioned relative to the adjacent segments or sections, a patient engaging member configured to engage the patient coupled to the proximal end portion of the adjustable support arm, a base coupled to the distal end portion of the adjustable support arms, a support arm position retention assembly to selectively secure or lock the adjustable segment arms in a desired position such that the patient engaging member engages and restrains the patient's head from movement during an operation or procedure.

The segments or sections of the adjustable support arms comprise elements each having a central channel or aperture formed therein to receive a flexible wire or cable therethrough The patient engaging member may be configured to comprise either a chin support or a jaw thrust support.

The support arm position retention assembly comprises a flexible wire or cable coupled between the patient engaging member and the base.

As previously described, the adjustable support arms comprise a plurality of segments or sections that can be moved relative to each other to position the adjustable supporting arms to engage the patient's chin or each side of the patient's jaw. The length of flexible wire or cable can be loosened or tightened by rotating or turning a positioning or locking knob coupled thereto to adjust the position and secure the position for the adjustable support arms.

To position or manipulate the chin support or jaw thrust supports to engage the head of the patient once the adjustable support arm(s) is/are secured to the base, the positioning or locking knob is rotatable to loosen the flexible wire or cable allowing the entire adjustable support arm(s) to bend, positioning or moving the patient engaging member(s) to engage either the chin or jaw of the patient. Once so positioned, the positioning or locking knob is rotated, tightening the flexible wire or cable and drawing the segments or sections together to secure or lock the adjustable support arm(s) in a patient engaging position. To release the patient from the positioning device, the process is reversed.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT OF THE INVENTION

Figure 1:
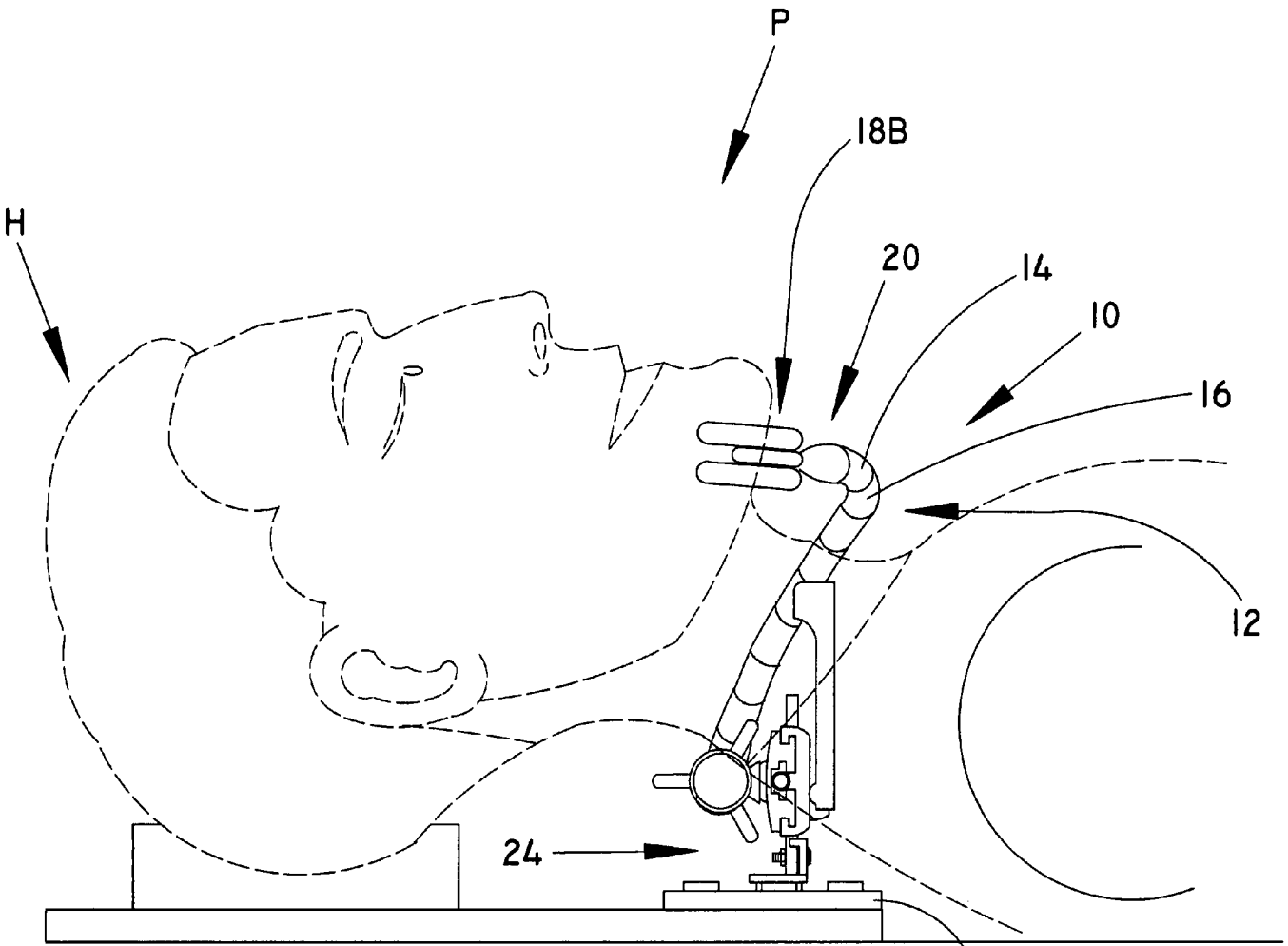
FIG. 1 is a side view of a patient with the positioning device of the present invention positioning the patient's head during an operation or procedure.
Figure 2:
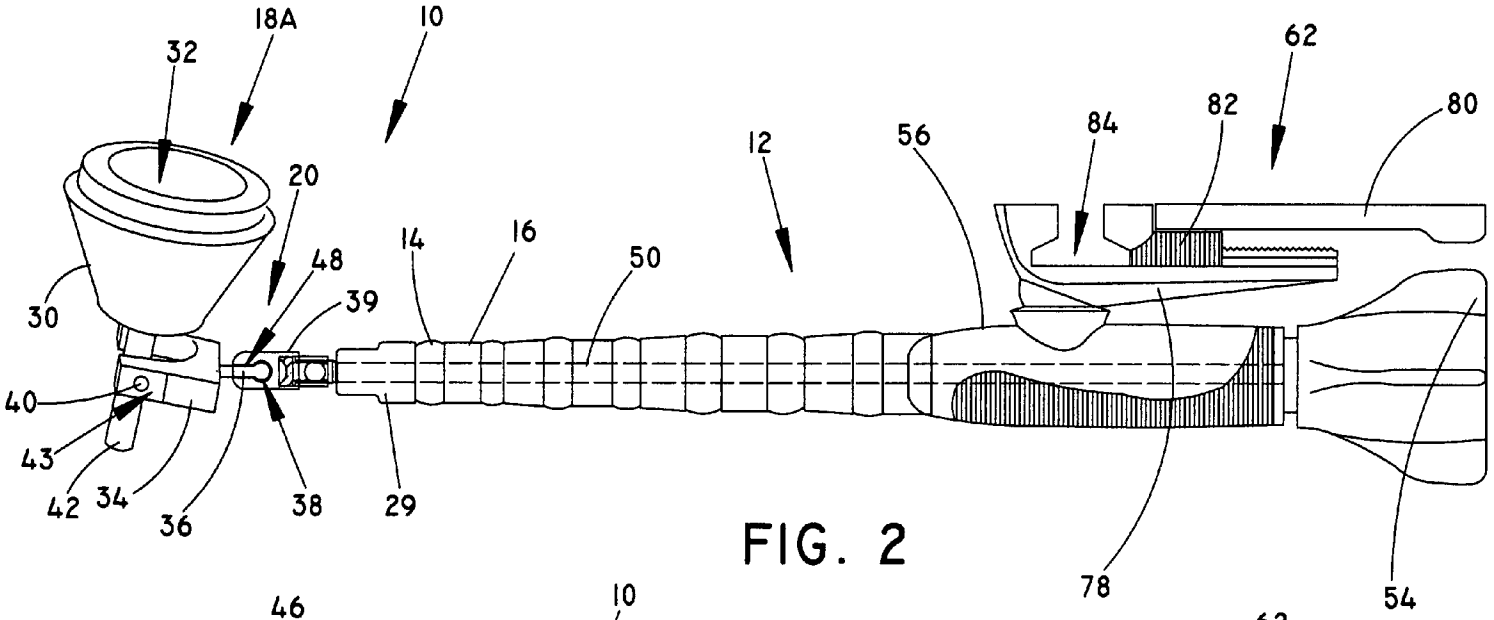
FIG. 2 is a detail view of the adjustable support arm of the present invention with a chin support as the patient engaging member.
Figure 3:
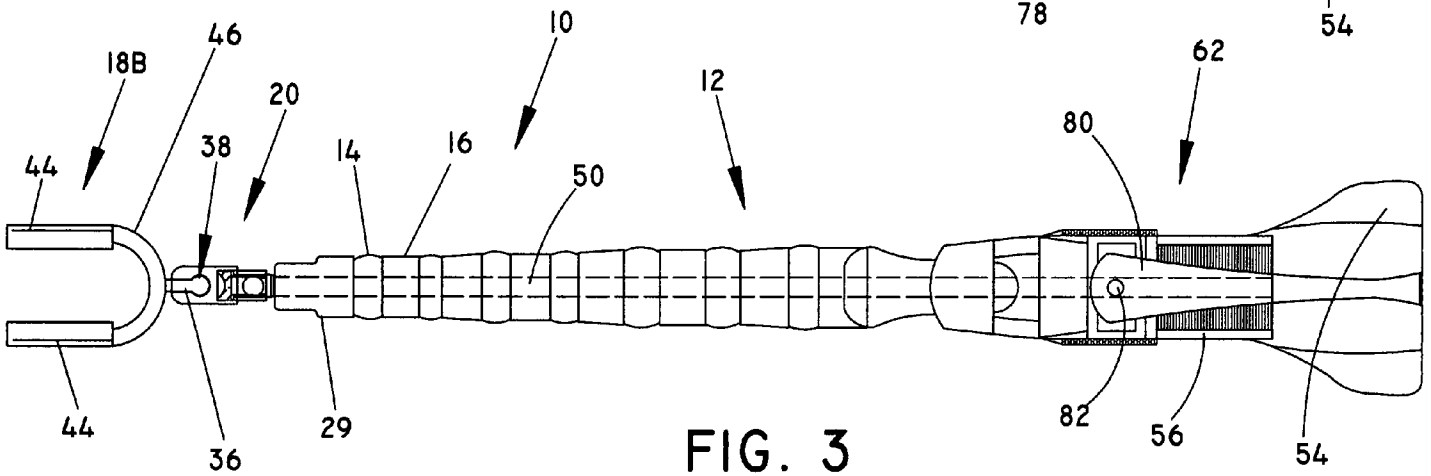
FIG. 3 is a detail view of the adjustable support arm of the present invention with a jaw thrust support as the patient engaging member.

As shown in FIGS. 1 through 3, the present invention relates to a positioning device generally indicated as 10 to maintain a patient's airway by restraining a patient's head H under anesthesia during an operation or procedure comprising at least one adjustable support arm generally indicated as 12 including a plurality of alternating segments or sections 14 and 16 configured to be selectively positioned relative to the adjacent segments or sections 14 and 16, a patient engaging member generally indicated as 18A or 18B configured to engage the patient P coupled to the proximal end portion of the adjustable support arm 12 by a proximal coupling device generally indicated as 20, a base generally indicated as 22 coupled to the distal end portion of the adjustable support arms 12 by a distal coupling device generally indicated as 24 and a support arm position retention assembly as described hereinafter to selectively secure or lock the adjustable segment arms 12 in a desired position such that the patient engaging member 18 engages and restrains the patient's head H from movement during an operation or procedure.

Although the positioning device 10 is described as including the base 22, the distal coupling device 24 can be attached directly to the operating room table or other support (not shown).

Figure 4A:
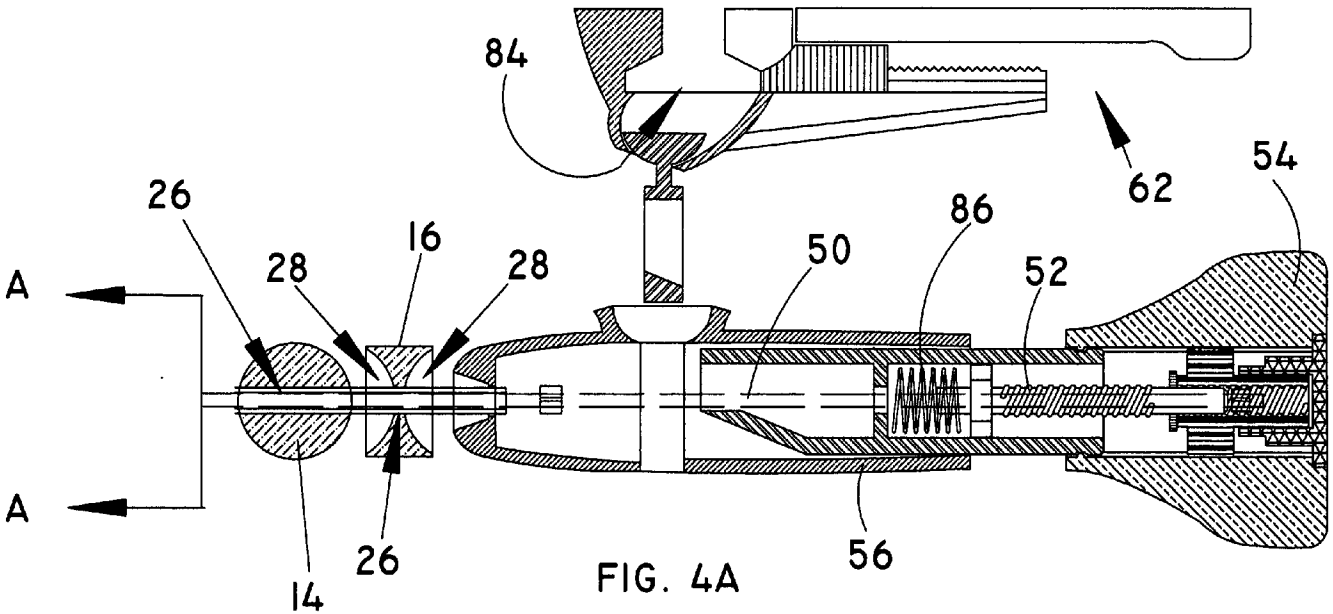
FIGS. 4A and 4B are cross-sectional views of the adjustable support arm of the present invention.
Figure 4B:
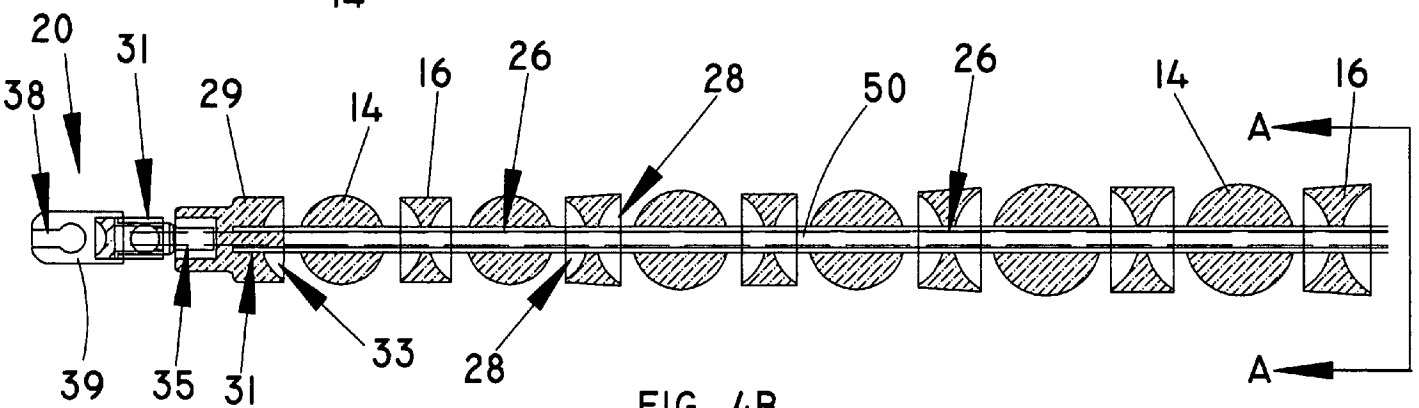

As best shown in FIGS. 4A and 4B, the segments or sections 14 and 16 of the adjustable support arms 12 comprise substantially spherical elements 14 and substantially cylindrical elements 16. A central channel or aperture 26 is formed through each of the substantially spherical elements 14 and each of the substantially cylindrical elements 16 to receive a portion of a flexible wire or cable therethrough described more fully hereinafter. A concave recess 28 is formed on opposite end portions of each substantially cylindrical element 16 to operatively receive a portion of the adjacent substantially spherical elements 14 therein. A proximal intermediate segment or section 29 including a central channel 31 formed through the mid-portion thereof having a concave recess 33 to receive a portion of the outer most substantially spherical element 14 therein with a recess 35 formed on the opposite end portion thereof to receive a portion of the proximal end portion generally indicated as 37 of the adjustable support arm position 12.

The patient engaging member 18 may comprise a chin support 18A as shown in FIG. 2 or a jaw thrust support 18B as shown in FIG. 3.

As shown in FIG. 2 the chin support 18A comprises a chin support body 30 having a concave chin receiving recess 32 formed in the face thereof to receive and support the patient's chin therein to restrain movement of the patient's head H during an operation or procedure. The chin support body 30 is pivotally and rotatably coupled to the proximal end portion of the adjustable support arm 12 by the first coupling member 20. The first coupling member 20 comprises a yoke member 34 rotatably coupled to the proximal intermediate segment or section 29 on the proximal end portion of the adjustable support arm 12 by an interconnecting pin or member 36 partially disposed with a channel and recess 38 formed in a connector element 39 and a mounting pin or member 40 to receive and support a connecting member 42 attached to the rear portion of the chin support body 30 by an aperture 43 to pivotally couple the chin support 18A to the first coupling member 20.

As shown in FIG. 3. the jaw thrust support 18B comprises a jaw engaging member including a pair of substantially parallel spaced apart jaw engaging elements each indicated as 44 extending from a yoke 46 rotatably coupled to the distal end portion of the adjustable support arm 12 by a the first coupling member 20 to engage and support one side of a patient's chin to restrain movement of the patient's head H during an operation or procedure. The first coupling member comprises a channel and recess 38 to receive a portion of the interconnecting pin 36. The first coupling member 20 may further include a slot 48 formed in the side thereof to permit the interconnecting pin or member 36 and yoke 46 of the chin support 18A and 18B to pivot.

As shown in FIGS. 2, 3 and 4A, the support arm position retention assembly comprises a flexible wire or cable 50 coupled to the intermediate segment or section 29 at the proximal end portion of the support arm 12, and coupled to an externally threaded first positioning element proximate a distal end of arm 12. The threaded first positioning element 52 extends through the central channel 26 to engage an internally threaded positioning or locking knob 54 that is rotatably mounted on a hollow handle 56. Handle 56 supports the distal or second coupling member 24 as described hereinafter. Such a support arm position retention assembly is sold under the trade mark Guidant. A similar retention or locking assembly is described in U.S. Pat. No. 4,700,691.

As previously described, the adjustable support arms 12 comprise a plurality of alternating segments or sections 14 or 16 that can be moved relative to each other to position the adjustable supporting arms 12 to engage the patient's chin or each side of the patient's jaw. The segments or sections 14 and the sleeve segments or sections 16 are alternately strung on the flexible wire or cable 50. The length of flexible wire or cable 50 can be loosened or tightened by rotating or turning the internally threaded positioning or locking knob 54, to adjust the position and secure the position for the adjustable support arms 12.

Figure 5:
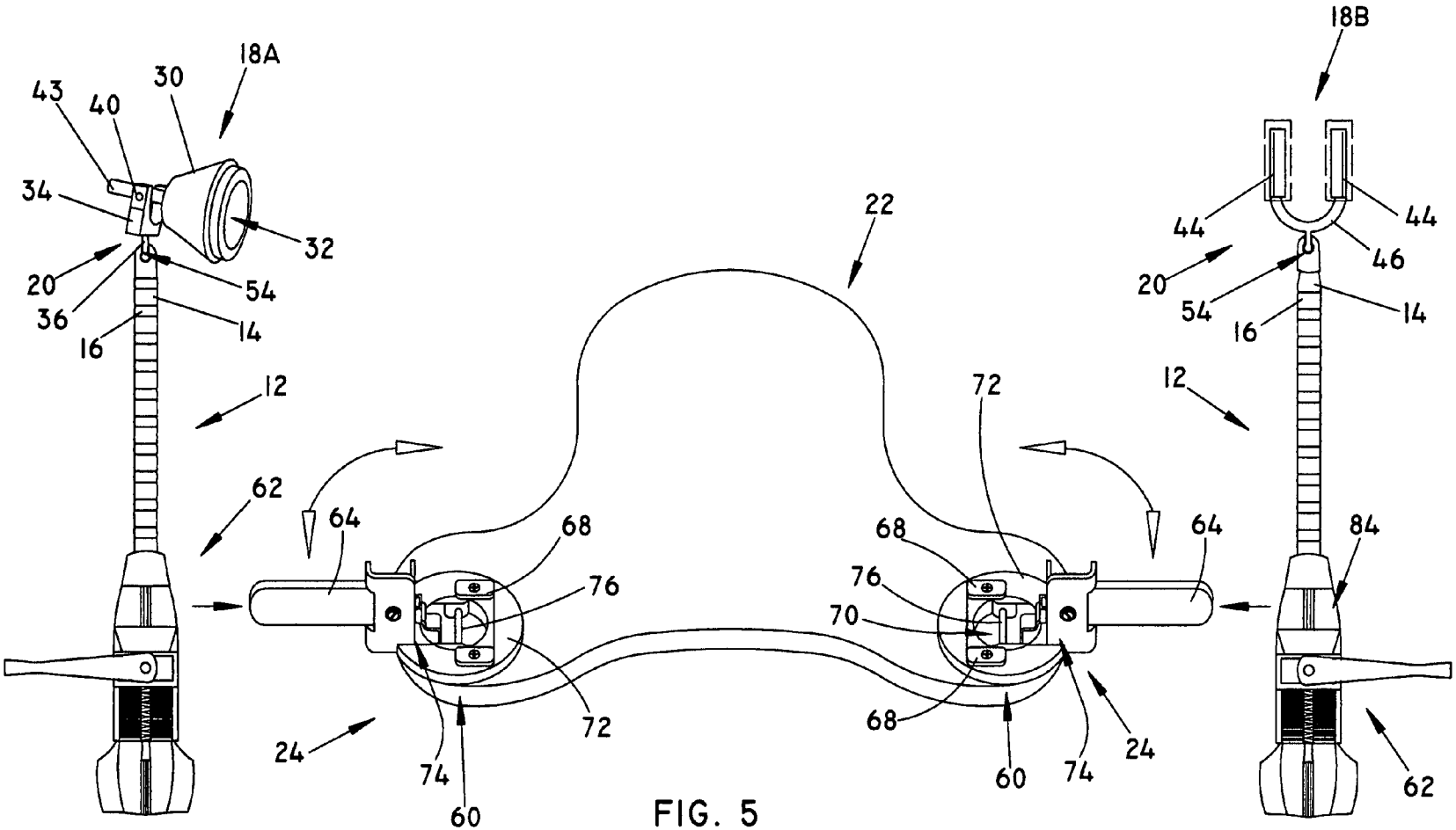
FIG. 5 is a perspective view of the base of the present invention.
Figure 6:
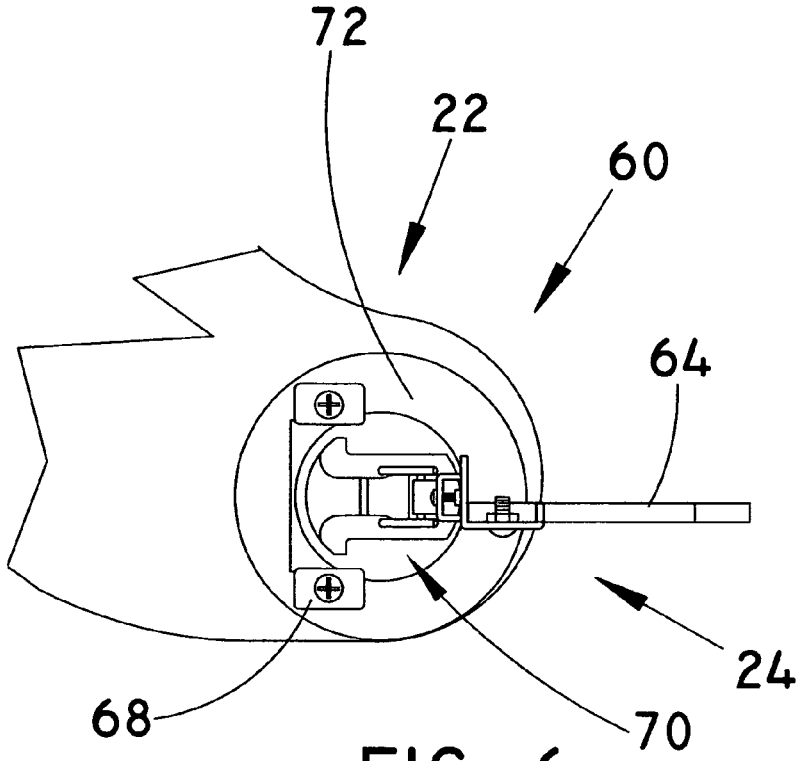
FIG. 6 is a top view of the first distal coupling device of the present invention.
Figure 7:
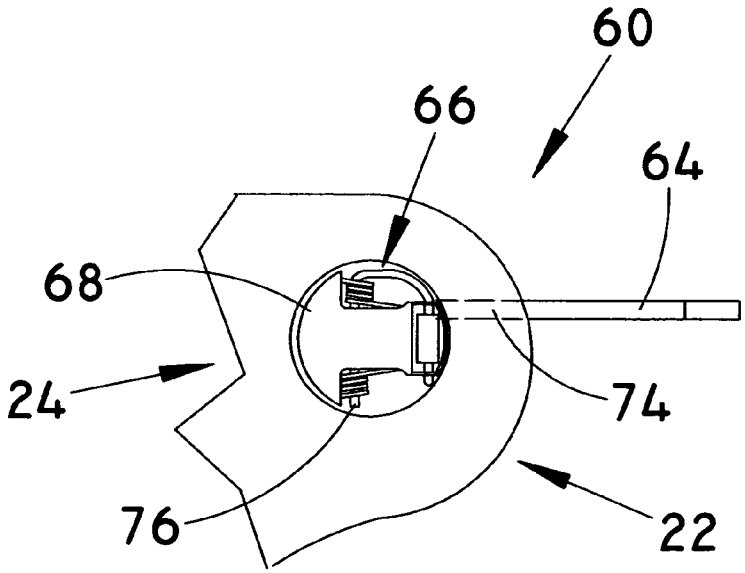
FIG. 7 is a bottom view of the first distal coupling device of the present invention.

The distal coupling device 24 comprises a first distal coupling device and a second distal coupling device generally indicated 60 and 62 respectively. As best shown in FIGS. 5 and 6, the first distal coupling device 60 comprises an attachment member 64 pivotally coupled to the base 22 including a recess or opening 66 by a mounting plate 68 including a recess or opening 70 concentrically aligned with the recess or opening 66 formed with a space 72 including a channel or groove 74 formed on the upper surface thereof. A bias or spring 76 is coupled to the mounting plate 68 by a pin 76 to engage the attachment member 64 to normally retain or maintain the attachment member 64 in a first or operative position. Should the patient awaken and move his/her head laterally the attachment member 64 will be moved to a second or open position, if the lateral force is greater then a predetermined amount or threshold is exerted by the patient's head. The second distal coupling device 62 comprises a coupling base 78 mounted to the handle 56 having a handle or lever 80 pivotally coupled thereto between a first or lock position (FIG. 2) and a second or release position (FIG. 3) by a pivot pin 82 to cooperatively form an attachment member slot 84 to receive the attachment member 64 therein to secure the adjustable support arms 12 to the attachment member 64 of the first distal coupling device 60 when in the first or lock position and to release the adjustable support arms 12 from the attachment member 64 of the first distal coupling device 60 when in the second or release position. A bias or spring 86 disposed between a flange 88 and a shoulder 90 formed or mounted to the end portion of the externally threaded first positioning element 52 coupled with the movement of the internally threaded positioning or locking knob 54 to loosen and tighten the flexible wire or cable 50 as described hereinafter.

To position or manipulate the chin support 18A or jaw thrust supports 18B to engage the head H of the patient P once the adjustable support arm(s) 12 is/are secured to the base 22 by the distal coupling device 24 with the first distal coupling device 60 held in the operative position by the bias or spring 76, the internally threaded positioning or locking knob 54 is rotatable to loosen the flexible wire or cable 50 allowing the entire adjustable support arm(s) 12 to bend, positioning or moving the patient engaging member(s) to engage to engage the chin or jaw of the patient P. Once so positioned the internally threaded positioning or locking knob 54 is rotated against the force of the positioning element or bias 86 tightening the flexible wire or cable 50 drawing the segments or sections 14 and 16 together to secure or lock the adjustable support arm(s) 12 in a patient engaging position as shown in FIG. 1. To release the patient from the restraining device 10 the process is reversed.

Since the attachment member 64 is normally retained in the first or operative position by the bias or spring 76 to inhibit lateral movement of the patient's head H (unless sufficient lateral force of a threshold or predetermined amount is exerted against the attachment member 64 to overcome the force of the bias or spring 76), moving the attachment member 64 to the second or open position thereby releases the patient's head H from the constraint of the positioning device 10.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A positioning device to maintain a patent airway by correctly positioning a patient's head during an operation or procedure, comprising:

at least one adjustable support arm including a plurality of segments or sections selectively positionable relative to adjacent segments or sections and selectively lockable relative to each other;

a patient engaging member coupled to a proximal end portion of the support arm, to engage a portion of the patient's head and restrain the patient's head during an operation or procedure;

a base;

a distal coupling device for coupling the adjustable support arm to the base; the distal coupling device comprising:

a first distal coupling device having (a) an attachment member that pivotally couples to the base by a mounting plate including a recess with a spacer having a groove formed on the upper surface of the spacer, and (b) a bias coupled to the mounting plate to selectively maintain the attachment member in a first or operative position, and a second or open position; and a second distal coupling device to couple said adjustable support arm to said base, the second distal coupling device including a coupling base mounted to a handle having a lever pivotally coupled thereto and being movable between a first or lock position and a second or release position, to cooperatively form an attachment member slot to receive the attachment member therein to secure the adjustable support arm to the attachment member when in the first or lock position and to release the adjustable support arm from the attachment member when in the second or release position.

2. The positioning device of claim 1, wherein said attachment member is retained in said first or operative position by said bias to prevent lateral movement of the patient's head unless sufficient lateral force is exerted against said attachment member to overcome the force of said bias moving said attachment member to said second or open position releasing the patient's head from said positioning device.

3. The positioning device of claim 1, wherein said patient engaging member is selected from (a) a chin support forming a chin receiving recess to receive and support the patient's chin, or (b) a jaw thrust support having a pair of spaced apart jaw engaging elements to engage the patient's jaw.

4. The positioning device of claim 1, further comprising a yoke member rotatably coupled to the proximal end portion of said adjustable support arm, between the proximal end portion of the adjustable support arm and the patient engaging member.

5. The positioning device of claim 1, including a pair of said adjustable support arms, each arm having a patient engaging member, the patient engaging member comprising a jaw thrust support for engaging opposite sides of the patient's jaw.

6. The positioning device of claim 1, the patient engaging member comprising a chin support having a chin support body that is pivotally and rotatably coupled to the proximal end portion of said adjustable support arm by a first coupling member.

7. The positioning device of claim 1, wherein said patient engaging member comprises a jaw thrust support including a jaw engaging member having a pair of spaced apart jaw engaging elements extending from a yoke that is rotatably coupled to the proximal end portion of said adjustable support arm by a first coupling member to engage the patient's jaw to restrain movement of the patient's head during an operation or procedure.

8. The positioning device of claim 1, wherein said segments or sections of said adjustable support arm comprise alternating substantially spherical elements and substantially cylindrical elements, each having a central channel formed therethrough to receive a flexible wire therethrough.

9. The positioning device of claim 8, wherein a concave recess is formed on opposite end portions of each substantially cylindrical element to operatively receive a portion of said adjacent substantially spherical elements therein.

10. The positioning device of claim 9, further including a support arm position retention assembly comprising said flexible wire coupled to the distal end portion thereof, and disposed to engage a locking knob moveable between an adjustable support arm locked position and an adjustable support arm released position to selectively lock or release said adjustable support arm, respectively.

11. The positioning device of claim 1, wherein said segments or sections the support arm are moveable relative to each other to position said adjustable supporting arm to engage the patient's head, said segments or sections being strung on a flexible wire, said flexible wire selectively loosened or tightened by rotating or turning a positioning or locking knob to adjust and secure the position of said adjustable support arm relative to the patient's head.

* * * * *